US011313040B2

(12) United States Patent
Martins et al.

(10) Patent No.: US 11,313,040 B2
(45) Date of Patent: Apr. 26, 2022

(54) PLASMA-ASSISTED PROCESS OF CERAMIZATION OF POLYMER PRECURSOR ON SURFACE, SURFACE COMPRISING CERAMIC POLYMER

(71) Applicants: EMBRACO INDÚSTRIA DE COMPRESSORES E SOLUÇÕES EM REFRIGERAÇÃO LTDA., Joinville (BR); Universidade Federal De Santa Catarina, Florianopolis (BR)

(72) Inventors: Nilda Martins, Florianopolis (BR); Martin Seifert, Bayreuth (DE); Gunter Siegfried Motz, Bayreuth (DE); Aloisio Nelmo Klein, Florianopolis (BR); Cristiano Binder, Florianopolis (BR); Jose Daniel Biasoli De Mello, Florianopolis (BR); Roberto Binder, Joinville (BR)

(73) Assignees: EMBRACO INDÚSTRIA DE COMPRESSORES E SOLUÇÕES EM REFRIGERAÇÃO LTDA., Joinville (BR); UNIVERSIDADE FEDERAL DE SANTA CATARINA, Florianopolis (BR)

( * ) Notice: Subject to any disclaimer, the term of this patent is extended or adjusted under 35 U.S.C. 154(b) by 0 days.

(21) Appl. No.: 15/468,921

(22) Filed: Mar. 24, 2017

(65) Prior Publication Data

US 2018/0272381 A1 Sep. 27, 2018

(51) Int. Cl.
*B05D 3/14* (2006.01)
*C23C 18/12* (2006.01)

(52) U.S. Cl.
CPC ..... *C23C 18/1208* (2013.01); *C23C 18/127* (2013.01); *C23C 18/1258* (2013.01)

(58) Field of Classification Search
CPC ... B05D 1/02; B05D 1/10; B05D 1/42; B05D 3/07; B05D 3/0254; B05D 3/0453;
(Continued)

(56) References Cited

U.S. PATENT DOCUMENTS 4,492,733 A * 1/1985 Phillips ..... C08J 7/123 428/412
5,707,715 A * 1/1998 deRochemont ..... H01L 23/142 428/210

(Continued)

OTHER PUBLICATIONS

Wikipedia (German version); "carbosilane" entry, plus partial online machine translation thereof, retrieved Sep. 7, 2018.*

(Continued)

*Primary Examiner* — Dah-Wei D. Yuan
*Assistant Examiner* — Kristen A Dagenais-Englehart
(74) *Attorney, Agent, or Firm* — Foley & Lardner LLP

(57) ABSTRACT

The present invention lies in the fields of chemistry and materials engineering. More specifically, the present invention describes a process of heat treatment of polymeric precursors including as active phases particle charge or a mixture of active phases with inert phases called "fillers". It is also described a surface including ceramic polymer obtained by said process. The volumetric positive variation resulting from the formation of new phases, which for their formation, incorporate atoms from the gaseous phase, contributes to a minor shrinkage of the composition during the heat treatment process. The process of the present invention allows obtaining the desired phases in smaller treatment times and lower temperatures, when compared to a thermal treatment process as conventional pyrolysis (PC) due to the presence of highly reactive species, as for example atomic nitrogen produced by the dissociation of nitrogen molecules in the plasma environment.

9 Claims, 4 Drawing Sheets

(58) Field of Classification Search
CPC ..... B05D 3/046; B05D 3/145; B05D 3/147; B05D 3/148; C23C 18/14; C23C 20/06; C23C 20/08
USPC ..... 427/447, 450, 452, 453, 489, 525, 527, 427/528, 530, 535, 536, 537, 562, 563, 427/574, 577, 578, 579
See application file for complete search history.

(56) References Cited

U.S. PATENT DOCUMENTS 6,143,432 A * 11/2000 de Rochemont ..... B32B 15/00 257/E23.006
6,544,657 B1 * 4/2003 Motz ..... C03C 17/30 427/387
6,576,300 B1 * 6/2003 Berry, III ..... C01B 33/126 257/E21.273
7,718,919 B2 5/2010 Machado et al.
8,354,294 B2 * 1/2013 de Rochemont ... C23C 18/1204 136/244
8,926,757 B2 * 1/2015 Binder ..... H01J 37/3244 134/1.1
9,023,493 B2 * 5/2015 de Rochemont ..... C23C 24/085 428/698
2009/0241496 A1 * 10/2009 Pintault ..... B01D 69/12 55/524
2011/0021007 A1 * 1/2011 de Rochemont ... C23C 18/1216 438/483
2011/0108059 A1 * 5/2011 Binder ..... H01J 37/32568 134/1.1
2012/0012403 A1 * 1/2012 de Rochemont ..... B24D 3/14 175/434
2012/0104358 A1 * 5/2012 de Rochemont ..... B82Y 10/00 257/14
2014/0110265 A1 * 4/2014 Fredenberg ..... B81C 99/0085 205/157
2015/0030856 A1 * 1/2015 Singh ..... B82Y 30/00 428/408
2016/0295676 A1 * 10/2016 Patelli ..... H05H 1/2406
2017/0015789 A1 1/2017 Li et al.
2018/0023185 A1 * 1/2018 Binder ..... H01J 37/32027 204/192.12
2018/0237724 A1 8/2018 Male et al.
2019/0168916 A1 6/2019 Wang et al.
2019/0169491 A1 6/2019 Hill et al.
2020/0123645 A1 * 4/2020 Binder ..... H01J 37/32027

OTHER PUBLICATIONS

Richard J Lewis, Sr., editor; Hawley's Condensed Chemical Dictionary, 12th edition; Van Nostrand Reinhold Company, New York; 1993 (no month); excerpt pp. 941 & 1037-1038.*
Webster's Ninth New Collegiate Dictionary; Merriam-Webster Inc., publishers; Springfield, Massachusetts, USA; 1990 (no month); excerpt p. 960.*
Ralf Riedel and I-Wei Chen "Ceramics Science and Technology, vol. 4: Applications" Ceramics Science and Technology (VCH) Sections 7.2.1 [retrieved Jul. 5, 2019].

* cited by examiner

PLASMA-ASSISTED PROCESS OF CERAMIZATION OF POLYMER PRECURSOR ON SURFACE, SURFACE COMPRISING CERAMIC POLYMER

FIELD OF THE INVENTION

The present invention lies in the fields of chemistry and materials engineering. More specifically, the present invention describes a process of thermal plasma-assisted treatment of polymeric precursors containing as charge, a dispersion of active phases or inert phases+active phases called "fillers" and ceramic coating obtained by said process.

BACKGROUND OF THE INVENTION

The greatest difficulty encountered during the processing of ceramics using polymeric precursors is the shrinkage that occurs during pyrolysis, i.e., during the conversion of the precursor polymer in ceramic phases. The transformation of amorphous ceramic polymer can present up to 50% volumetric shrinkage, promoting high porosity and defects. An alternative for overcoming this problem is the use of active phases and/or inert charges, i.e., the use of fillers. The fillers (that can be particles of active phases, i.e., reactive) mixed to polymeric precursors, act reacting with the oven atmosphere present during the pyrolysis heat treatment and/or with the polymer precursor, forming new phases with larger specific volume, whose volumetric growth compensates the retraction, reducing porosity which results from pyrolysis.

The Polymer Derived Ceramic (PDC) is an originally organometallic polymer that can be converted into ceramic material by heat treatment (pyrolysis). Usually these polymers contain silicon and are used for obtaining ceramics like: SiC, $Si_xN_y$, SiCN, SiCO and BN.

Polymeric precursors have been recognized as a new alternative for manufacturing advanced ceramics, having advantages over the traditional process, commonly performed from the powder technology. Among these benefits the following are highlighted:

(a) the possibility of processing in relatively lower temperatures, between 800 and 1500° C.;

(b) the possibility of production of near net shape components, due to the geometric precision associated with the process and viability of processing techniques.

Precursors-based coatings are an alternative, with relative low cost, for obtaining ceramic coatings on semi-finished and finished parts. These coatings combine the ease of processing of polymer derived ceramic (PDC) and the favorable properties of the resulting ceramic containing silicon, like thermal stability, thermal shock resistance, high values of hardness or resistance to abrasion and corrosion.

The most applied precursor polymers to ceramic conversion by pyrolysis for obtaining coatings are the precursors containing silicon as polycarbosilanes, polysilazanes or polysiloxanes. And the most common techniques to coat the pieces with the polymer precursor suspension containing particles of fillers are: dip coating, tape casting, spin coating, and spray. During the pyrolysis heat treatment of coated parts, it is formed the corresponding ceramic phases, SiC, $Si_XN_Y$, SiCN or $SiO_2$, depending on the chemical composition of the gas phase in the oven in which the pyrolysis is performed.

The conversion of the polymer to ceramics during pyrolysis heat treatment, is associated with a high volumetric shrinkage of up to 50% by volume, which promotes the formation of defects, cracks or even delamination of coatings. Furthermore, the formed ceramic presents high porosity, which can compromise the mechanical performance thereof. However, using the process of active-filler-controlled pyrolysis of pre-ceramic polymers (AFCOP), i.e., the controlled pyrolysis of polymers and active fillers, developed by Greil, adding filler particles such as Ti, Cr, Fe, Al, Nb, Hf, $TiSi_2$, $CrSi_2$, $TiB_2$, these reported issues can be significantly reduced. The active fillers contribute to offset the shrinkage by reactions between the precursor decomposition products (as free carbon and hydrocarbons $CH_4$, $C_2H_5$, $C_6H_6$, etc.) and/or with the pyrolysis atmosphere. The incorporation of fillers to the precursor also permits adjusting and modeling the mechanical, physical or chemical properties of coatings. It should be noted that even in systems where the active fillers are present, the inert fillers such as $Al_2O_3$, SiC, BN, $Si_3N_4$, $ZrO_2$, can be added to stabilize the distribution of active fillers, reducing sedimentation effects during the process.

By the addition of $Al_2O_3$ or $TiSi_2$ particles, Labrousse et al. and Torrey et al., for example, have developed ceramic composite coatings on steel with a coating thickness of 10 and 20 μm, respectively.

General Considerations about DC Plasma

According to Chapman, 1980, cold plasma is a partially ionized gas, consisting of the same number of positive and negative charges (which keeps the system electrically neutral), and a different amount of atoms or neutral non-ionized molecules. The degree of ionization of these cold plasmas is on the order of $10^{-4}$ to $10^{-5}$.

One way to generate the plasma is by the passage of electric current through a gas, in a controlled medium. Reaching a certain number of charge carriers, the dielectric breakdown occurs, or rupture of the gas, and the gas becomes electrically conductive, generating electrical discharge phenomena.

These electrical discharges can be generated by applying a potential difference (DDP) between two electrodes, called cathode and anode, in gaseous medium at low pressures. Said setting used for plasma production aims to make ions and free electrons being accelerated by the formed electric field, enabling the gas ionization of the system due to a ripple effect caused by several collisions.

The electrical discharges characteristics generated depend on the parameters of the process, such as the material and geometry of the cathode and the anode, the applied electrical voltage, the kind of applied voltage, working pressure and the type of gas, that can be classified in different regimen, as shown in FIG. 1.

The abnormal glow discharge, as indicated in FIG. 1, is the most used in materials processing in a plasma reactor, for it allows greater control of the discharge and allows the cathode being fully involved by the plasma, causing the process to be more uniform.

The glow discharge, when formed between the cathode and the anode, has as feature presenting three distinct regions: the cathode sheath, glow region (equipotential) and anodic sheath. The cited regions and the distribution of the potential between the electrodes are schematized in FIG. 2. In this configuration, the cathode is negatively polarized and the anode remains grounded (null potential).

The cathode sheath is characterized by the presence of strong electric, field, due to the distribution of potential ranging from the applied voltage on the cathode ($-V_0$) to a slightly positive voltage ($V_P$) relative to the plasma potential. This strong electric field contributes to the acceleration of previously formed ions in glow region. These ions are accelerated toward the cathode causing the ionic bombardment thereon. In addition, these ions may collide with neutral atoms and/or molecules, causing symmetric exchanges of charges, and generating from this point a molecule or neutral fast atom and a slow ion. Thus, the species that bombard the cathode are mainly ions and molecules and/or neutral fast atoms. This bombardment against the cathodic surface can cause various phenomena, such as: heating, secondary electron emission with driven route to glow region, sputtering, ion implantation on crystal structure and generation of surface defects. FIG. 3 illustrates the interactions that may occur on the surface of a part to be disposed on the cathode surface during the processing.

The three main characteristics of the glow region are: positive potential, characteristic luminescence and electric field practically null. It is in this region that are concentrated most of the reactions responsible for the formation of active species, which are of fundamental importance in the treatment of materials by plasma.

The most important reactions that occur in this region are: ionization, dissociation and excitation.

The ionization is mainly produced by inelastic collisions of electrons and atoms or molecules of the gas, which when colliding form one ion and two electrons, according to the reaction: $e^-+X \rightarrow 2e^-+X^+$, where X represents an ion or molecule and $e^-$ an electron. For the ionization occurrence, it is necessary to achieve the activation energy, which is associated with the ionization potential.

The excitement occurs by the collision between electrons and atoms or molecules, but in this case, the transferred energy is lower than the ionization energy. The activation energy is associated with the potential for excitement. The excitement reaction is represented by: $e^-+X \rightarrow e^-+X^*$, where $X^*$ represents the excited atoms or molecules. This excitement state is unstable, and tends to return to equilibrium. This change between energy levels is responsible for the glow of the discharge.

The process of dissociation is related to the rupture of chemical bonds between atoms of a molecule, as a result of the transfer of electrons energy due to inelastic collisions with molecules. The reaction can be represented by: $e^-+X_n \rightarrow e^-X_1+X_2+\ldots X_n$. In this representation, X refers to the atoms of the molecule.

In the anodic sheath, it is produced an electric field of low intensity, but sufficient to trap a quantity of electrons on light-emitting region and thus, enabling the maintenance, of the discharge. Likewise, as in the cathodic region, the ions accelerated towards the anode surface also contribute to the emission of secondary electrons. However, only the high-energy electrons reach the anode. During the process of materials in a plasma reactor, when a pulsed voltage source is used, it is possible to also have a contribution of bombardment of ions at the anode, due to a redistribution of the potential during the off pulse period.

The literature shows that organosilazanes precursors SiCN, charged with active fillers $TiSi_2$ provide materials or coatings on Ti—Si—CN system, with excellent mechanical properties, however the $TiSi_2$ does not fully react at temperatures below 1000 in nitrogen, which indicates being possible to obtain superior results to those already found out if changing said conversion rate in pyrolysis process assisted by DC plasma.

Thus, it is clear the need of improved processes that allow the formation of coatings in less time and that present more efficient properties.

SUMMARY OF THE INVENTION

The present invention aims to solve the problems present in the prior art from the common inventive concept to all protection contexts claimed, that is the use of a heat treatment process of polymeric precursors comprising (e.g. particles) fillers in the presence of reactive species generated in the plasma environment (glow discharge).

In the present invention, the pyrolysis heat treatment process of precursor polymers comprises as charge active phases or a mix of active phases+neutral phases named "fillers". The ceramic coating obtained by said process also is an object of the invention. The volumetric positive variation resulting from the formation of new phases, that for their formation incorporate atoms from the gaseous phase, contributes to a minor retraction of the composition during the pyrolysis heat treatment process.

In a first embodiment, the present invention presents a ceramization process of polymer precursor containing charges (fillers) on surface comprising the steps of:

(a) preparation of a suspension comprising:
at least one polymer precursor;
at least one filler;
at least one solvent; and
at least one dispersant;

(b) application of said suspension on at least one component surface; and (c) heat treatment of the suspension in a medium that contains at least one reactive species from the dissociation of at least one molecule selected from the group consisting of hydrogen, nitrogen, hydrocarbons or combinations thereof, which optionally are diluted in argon and/or another inert gas.

On an embodiment of the process of the invention, the fillers are particles and the surface of the component is selected among metallic, ceramic and/or composite.

It is a second object of the invention a ceramic composite-coated component obtained by the process described above, in which the after-ceramized polymer precursor is formed by at least one phase selected from the group consisting of SiCN, $Si_xN_y$ (e.g. $Si_3N_4$), SiC, BCN, BN, TiCN, and SiCMN, wherein M is a transition metal, or combinations thereof.

BRIEF DESCRIPTION OF THE FIGURES

In order to better define and clarify the content of the present patent application, the following figures are presented.

(A) produced by the conventional pyrolysis process and (B) produced by an embodiment of the invention process of plasma-assisted pyrolysis (PAP-C), cathode configuration sample in the plasma reactor. Both samples were treated for 2 hours at 1150° C.

Figure 5:
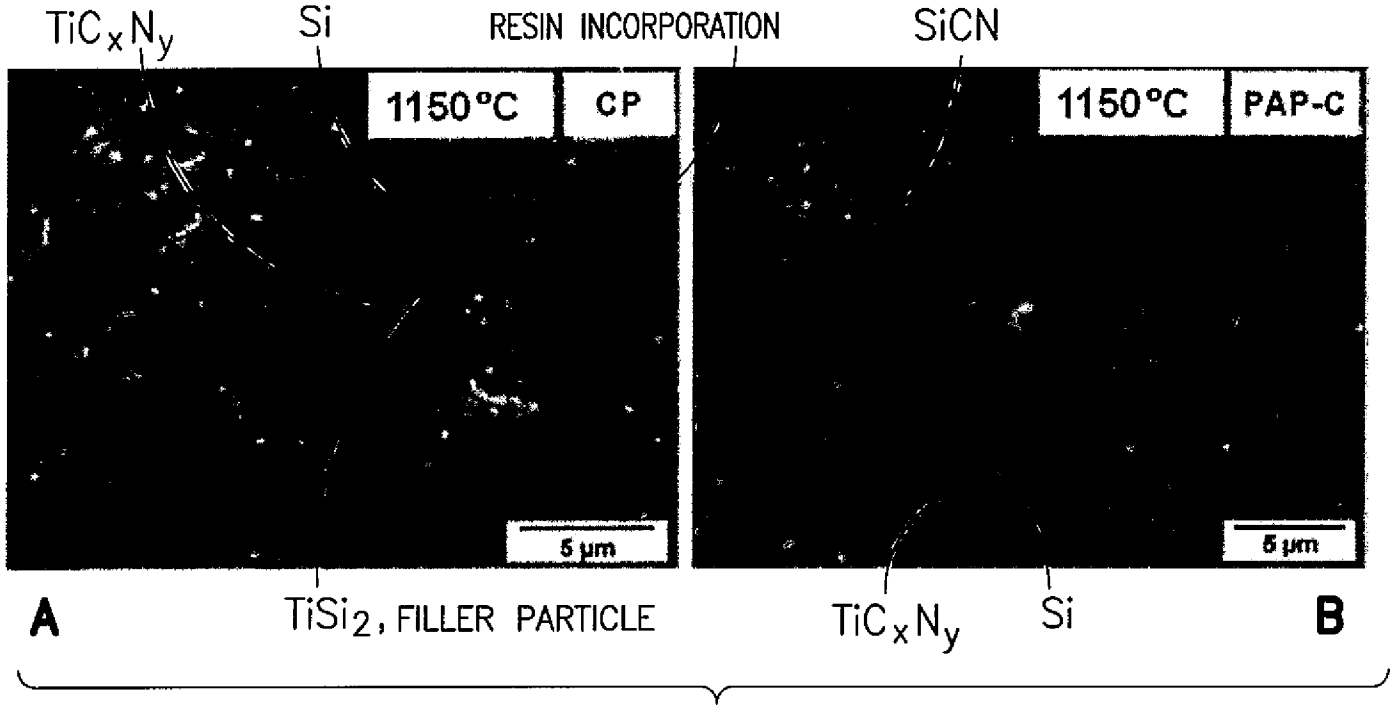

FIG. 5 shows the images obtained by scanning electron microscopy (SEM), of the phase composition of samples $TiSi_2$/HTTS (70/30 vol. %): A) produced by conventional pyrolysis process and B) produced by plasma-assisted pyrolysis process (PAP-C), sample in cathode configuration. Both samples were treated for 2 hours at 1150° C.

Figure 6:
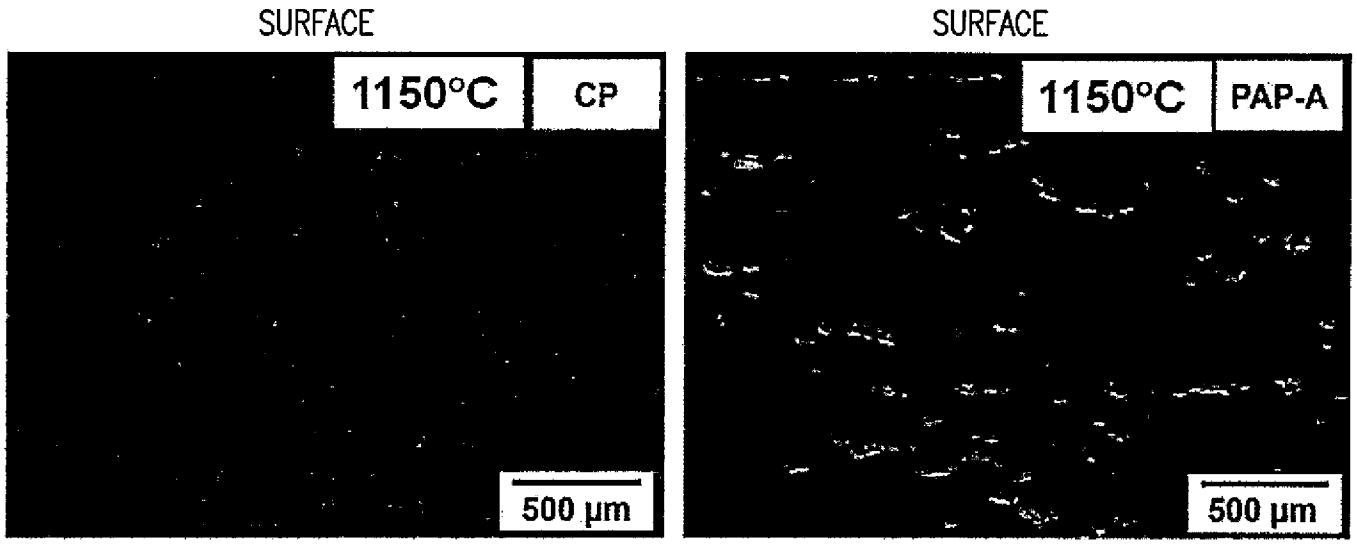

FIG. 6 shows images of micrographs obtained by scanning electron microscopy (SEM), of $TiSi_2$/HTTS samples (70/30 vol. %): A) produced by the conventional pyrolysis process and B) produced by plasma-assisted pyrolysis process (PAP) with the samples in the anode configuration in the plasma reactor. Both samples were treated for 2 hours at 1150° C.

DETAILED DESCRIPTION OF THE INVENTION

The present invention provides a process and a product that solves the following technical problems/lead to the following benefits: a) increased conversion rate of active fillers mixed with polymer precursor, during the heat treatment step, generating nitrides and carbonitrides by reaction with atomic nitrogen generated in the plasma reactor environment and/or from the carbon present in the polymeric precursor. This provides the achievement of the desired phases in smaller treatment times and lower temperatures, when compared to a thermal treatment process as the conventional pyrolysis (CP).

In an embodiment, it is used a plasma-assisted pyrolysis treatment (PAP). It can be understood as plasma-assisted pyrolysis (PAP) the pyrolysis heat treatment process performed in ionized gas (glow discharge) at a plasma reactor. By conventional pyrolysis, it is understood here the one performed in gaseous atmosphere in conventional ovens, i.e., in the absence of plasma.

The atmosphere used in the plasma reactor consists of a gas stream, whose the chosen composition depends on the phases that it is wanted in the heat treatment process. For obtaining nitrides on ceramic composition layer, it is used a stream gas of $N_2$+$H_2$. As a result of electrical discharge between cathode and anode, the gas is ionized. The electrons present in the ionized gas are attracted to the anode, and along the way, they suffer inelastic collision with gas molecules, causing its dissociation. For example, electrons possessing high kinetic energy collide with nitrogen molecules ($N_2$) causing the dissociation of part of nitrogen molecules, producing atomic nitrogen (reaction: $N_2+e^-=e^-+2N$), which advantageously reacts with the metallic atoms of the active fillers. Similarly, atomic hydrogen is formed by the dissociation of $H_2$ (reaction: $e^-+H_2=e^-+2H$) when there is hydrogen in the gas mixture. The atomic hydrogen beneficially reacts with oxide films usually present on the surface of the fillers particles.

The presence of atomic nitrogen present in the plasma environment, more reactive than the molecular nitrogen, allows the increasing of the conversion rate of metallic fillers in carbonitrides and nitrides. The volumetric positive variation resulting from the formation of new phases, which for their formation, incorporate atoms from the gaseous phase, contributes to a minor shrinkage of the composition during the heat treatment process. In addition, atoms from the gaseous atmosphere are also incorporated into the polymer precursor ceramization.

The fillers can be of various natures (metallic, intermetallic and ceramic), and are generally added particles to the polymeric precursor for reducing the porosity and/or giving specific properties to the final material formed; in the case of fillers being of active type, they react with the atmosphere of pyrolysis and with the precursor forming new phases, being the fillers used: Ti, Cr, V, Mo, B, $MoSi_2$, Fe, Al, Nb, Hf, $TiSi_2$, $CrSi_2$, $TiB_2$, Si, Al, $Al_2O_3$, SiC, BN, $Si_3N_4$, $ZrO_2$, $B_4C$, or combinations thereof.

The combination of polymeric precursor, active and inert charges and the variation of the atmosphere results in a greater variety of ceramics and composites materials, wherein some of them are not obtainable by other techniques.

In an embodiment the ceramization process of surface polymer comprises the steps of:

(a) preparation of a suspension comprising:
at least one polymer precursor;
at least one filler;
at least one solvent; and
at least one dispersant;

(b) application of said suspension on at least a metallic component surface;

(c) heat treatment of the suspension in a medium that contains at least one reactive species resulting from the dissociation of at least one molecule selected from the group consisting of hydrogen, nitrogen, hydrocarbons or combinations thereof.

The process of heat treatment is by plasma-assisted pyrolysis. In one embodiment, the plasma-assisted pyrolysis is performed in a plasma reactor in a setting selected from the group consisting of cathode, anode or floating potential. In one embodiment, the plasma-assisted pyrolysis is performed in a plasma reactor at cathode configuration.

In an embodiment of the process, said polymer precursor is selected from the group consisting of polysilanes, polysilsesquilazanes, polycarbosilanes, polysilazanes, doped polysilazanes, polysilylcarbodiimides, polyborosilanes, organometallic polymer comprising carbon, or combinations thereof.

In an embodiment of the process, said organometallic polymer is selected from the group consisting of polyorganosilanes, polyorganocarbosilanes, polyorganosilylcarbodiimides, polysiloxanes, polyorganosilazane, or combinations thereof.

In an embodiment of the process, the active filler is selected from the group consisting of Ti, Cr, V, Mo, B, $MoSi_2$, Fe, Al, Nb, Hf, $TiSi_2$, $CrSi_2$, $TiB_2$, Si, Al, $B_4C$, or combinations thereof, and the inactive filler is selected from the group consisting of $Al_2O_3$, SiC, BN, $Si_3N_4$, $ZrO_2$, or combinations thereof.

In an embodiment of the process, the surface is a metallic surface.

In an embodiment of the process, the step (b) of applying a suspension on at least one surface of a metallic component is carried out by a technique selected from the group consisting of immersion, spray, spin coating or casting tape.

In an embodiment of the process, the step (c) of thermal treatment is carried out at a pressure of about $1.33\times10^1$ Pascal (0.1 Torr) to $1.33\times10^4$ Pascal (100 Torr), for 2 hours at a temperature of 1150° C. Step (c) may be carried out for 30 minutes to 300 minutes, at a temperature of 800 to 1200° C.

In a second object, the present invention presents a ceramic composite coated component obtained by the above process in which the polymer precursor after ceramized is formed by at least one phase selected from the group consisting of SiCN, $Si_xN_y$ (e.g. $Si_3N_4$), SiC, BCN, BN, TiCN, and SiCMN, where M is a transition metal.

In one embodiment, the present invention presents said process of heat treatment comprising the following steps:

(a) Preparing of the suspension containing the polymeric precursor, fillers, solvent and dispersants, under the conditions and quantities required for each system; said step includes the dispersion of fillers and homogenization of the suspension by mechanical magnetic agitation or ultrasonic and roller mills;

(b) Applying the suspension, prepared in accordance with the procedure written in item (a), on the finished parts by immersion techniques, spray, spin coating or tape casting, wherein the choice of the technique to be used depends on the geometry of the finished piece to be covered; the part or component can be produced by the following manufacturing processes: powder metallurgy, casting, rolling, machining, extruding and forming;

(c) Heat treating by plasma-assisted pyrolysis the polymeric suspension coated component comprising the fillers, where advantageously occurs the conversion of the ceramic polymer, as well as the conversion of particle fillers in nitrides and carbonitrides, by the reaction of these particles with the plasma reactive atmosphere, generated in the reactor during the pyrolysis heat treatment.

In one embodiment, said suspension is applied, by immersion or spray techniques, on finished metallic components for granting resistance to deterioration and, in other applications, in finished components to provide corrosion protection. The components (parts) to be coated (coating substrates) are produced by different manufacturing processes of parts, such as powder metallurgy, casting, machining and forming. The precursor polymer containing active fillers particles is applied to the finished parts. After applying the coating they undergo a heat treatment called pyrolysis, in a hybrid plasma reactor. The hybrid plasma reactor is described in the document U.S. Pat. No. 7,718,919 B2.

In the context of the patent application, "plasma" must be understood as a partially ionized gas, consisting of the same number of positive and negative charges (which keeps the system electrically neutral), and a different amount of atoms or non-ionized neutral molecules.

In the context of the patent application, "ceramic" should be understood as a material comprising a three-dimensional crystalline grain network comprising at least a metal attached to carbon, nitrogen or oxygen atoms.

EXAMPLES—EMBODIMENTS

The examples shown herein are intended only to illustrate some of the many ways to carry out the invention, without, however, limiting the scope of the same.

Example 1

Figure 1:
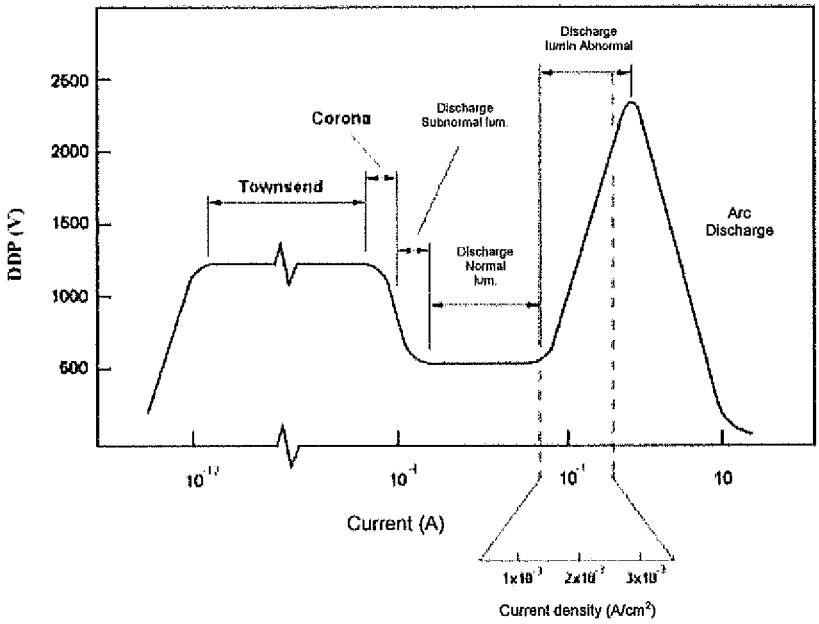
FIG. 1 shows a graph of the characteristic curve of the current versus DDP of a glow discharge.
Figure 2:
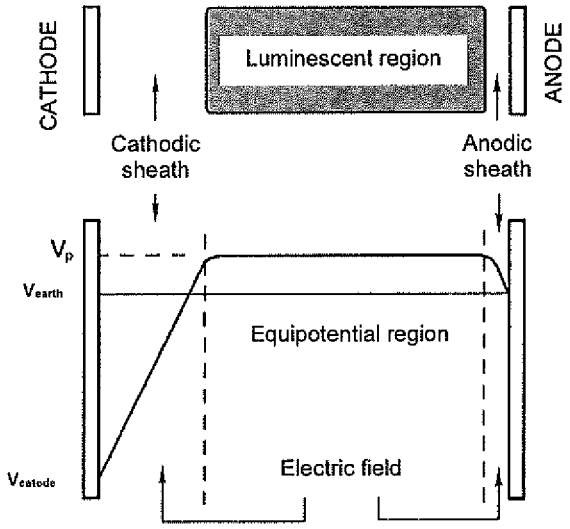
FIG. 2 shows a scheme of the potential distribution between the electrodes in an abnormal glow discharge.
Figure 3:
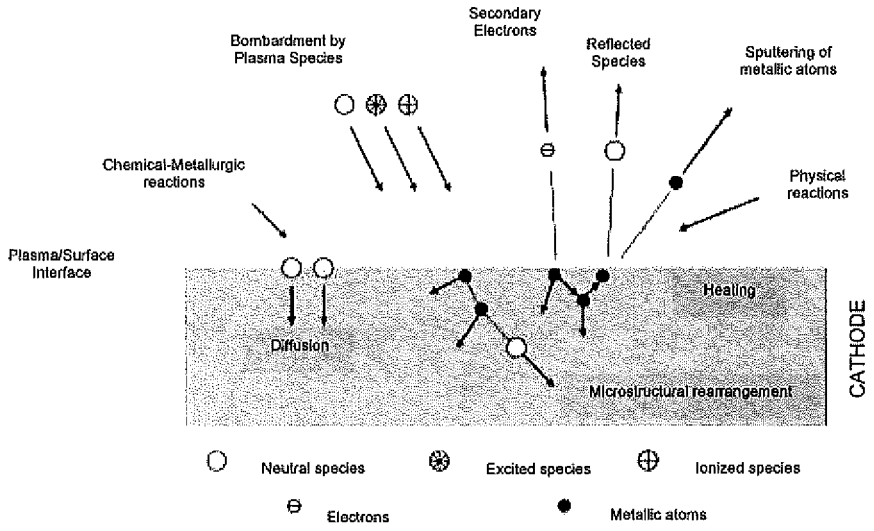
FIG. 3 shows a scheme of interaction of the ions with the cathodic surface.
Figure 4:
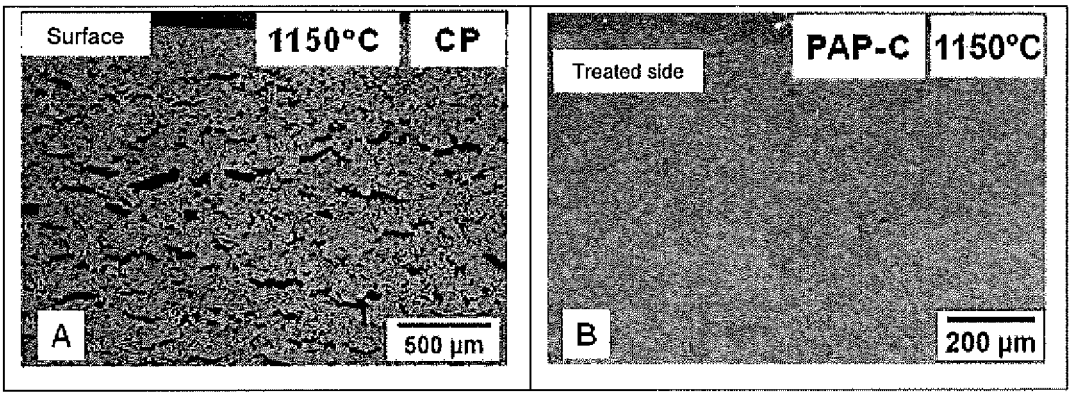
FIG. 4 shows images of micrographs obtained by scanning electron microscopy (SEM), of $TiSi_2$/HTTS samples (70/30 vol. %)

Production of PDCs with polymer precursor HTTS organo(silazanes) group, loaded with 70% by volume of $TiSi_2$ (titanium disilicide) as active fillers provide ceramic materials of Ti—Si—CN system, that have remarkable mechanical properties by nature, with high values of hardness and wear resistance. FIG. 4 shows the difference in microstructure by micrographs obtained by scanning electron microscopy (SEM), and in residual porosity measured via picnometer of helium, after pyrolysis heat treatment carried out by 2 hours at 1150° C., where the FIG. 4A shows the result obtained by conventional pyrolysis of nitrogen gas flow ($N_2$) while the FIG. 4B shows the result obtained on nitrogen plasma-assisted pyrolysis, with the samples in the cathode configuration of the reactor (PAP-C). The sample A has a porosity of 28% and the sample B presents a porosity of less than 2% in volume.

FIG. 5 shows the phases formed by the reaction of $TiSi_2$ particles (filler particles) with the atmosphere in the pyrolysis heat treatment. The expected result is the maximum of possible conversion of $TiSi_2$ (Titanium disilicate) in TiCN (titanium carbonitrate). The phases were identified by x-ray diffraction, chemical composition analysis via EDS and scanning electron microscopy. In conventional pyrolysis, for 2 hours at 1150° C., the titanium carbonitride formed is limited to a thin layer on the surface of the particles of $TiSi_2$ mixed to the polymer precursor (carbonitride layer thickness <1 μm); as to the plasma-assisted pyrolysis, with the samples connected to the cathode (cathode configuration), there was the reaction throughout the entire volume of $TiSi_2$ particles.

Example 2

FIG. 6 shows the difference in microstructure, by micrographs obtained by scanning electron microscopy (SEM), and in residual porosity, measured via helium pycnometer, after pyrolysis heat treatment carried out for 2 hours at 1150° C., where the FIG. 6A shows the result obtained by conventional pyrolysis in nitrogen gas flow ($N_2$) while the FIG. 6B shows the result obtained on the nitrogen plasma-assisted pyrolysis, with the samples in the anode reactor configuration (PAP-A). The sample A has a porosity of 28% and the sample B presents a porosity of approximately 21% in volume.

Examples 1 and 2 presented prove that the results obtained in plasma environment are superior to those obtained in conventional pyrolysis, especially when samples are connected with the cathode.

The person skilled in art will understand the value of the knowledge presented herein and can reproduce the invention in the presented embodiments and in other variants, which are covered in the scope of the attached claims.

The invention claimed is:

1. A ceramization process of a polymer precursor suspension containing at least one polymer precursor and at least one active filler or a mixture of the at least one active filler with at least one inert filler on at least one component surface, wherein the at least one inert filler is an agent added to stabilize distribution of the at least one active filler in the suspension, reducing sedimentation effects during the process, the process comprising the steps of:

(a) preparation of the suspension comprising:
said at least one polymer precursor;
the at least one active filler;
at least one solvent; and
at least one dispersant;

(b) application of said suspension on the at least one component surface, forming at least one suspension coated component surface; and (c) plasma-assisted pyrolysis heat treatment of the at least one suspension coated component surface in a medium that contains at least one reactive species from dissociation of molecules of at least one molecular species selected from the group consisting of hydrogen, nitrogen, hydrocarbons or combinations thereof, wherein the plasma-assisted pyrolysis heat treatment is DC plasma-assisted pyrolysis, and wherein the plasma-assisted pyrolysis heat treatment is performed at a pressure of about $1.33\times10^1$ Pascal (0.1 Torr) to $1.33\times10^4$ Pascal (100 Torr) and is carried out for 30 minutes to 300 minutes at a temperature of 800 to 1200° C.; and with the heat treatment by DC plasma-assisted pyrolysis, obtaining, from the at least one suspension coated component surface, a polymer derived crystalline ceramic from the at least one polymer precursor, wherein the polymer derived crystalline ceramic comprises a phase formed by reaction of the at least one active filler with the at least one reactive species.

2. The process according to claim 1, characterized by said at least one polymer precursor being an organometallic polymer.

3. The process according to claim 2, characterized by the organometallic polymer being selected from the group consisting of polyorganosilanes, polyorganocarbosilanes, polyorganosilylcarbodiimides, polyorganosilazanes, and combinations thereof.

4. The process according to claim 1, characterized by said active filler being selected from the group consisting of: Ti, Cr, V, Mo, B, $MoSi_2$, Fe, Al, Nb, Hf, $TiSi_2$, $CrSi_2$, $TiB_2$, Si, and $B_4C$ and/or said inert filler being selected from the group consisting of: $Al_2O_3$, SiC, BN, $Si_3N_4$, $ZrO_2$, as well as combinations of the active fillers and the inert fillers in the same suspension.

5. The process according to claim 1, characterized by said at least one component surface being a metallic surface.

6. The process according to claim 1, characterized by the step (b) of applying said suspension on the at least one component surface being carried out by a technique selected from the group consisting of immersion, spray, spin coating, and casting tape.

7. The process according to claim 1, characterized by the plasma-assisted pyrolysis being carried out in a plasma reactor at a cathode or an anode.

8. The process according to claim 7, characterized by the plasma-assisted pyrolysis being carried out in a plasma reactor at the cathode.

9. The process according to claim 2, characterized by the organometallic polymer being selected from the group consisting of polycarbosilanes, polysilazanes, doped polysilazanes, polysilylcarbodiimides, polyborosilanes, and combinations thereof.

* * * * *